US007757984B2

(12) United States Patent
Lin et al.

(10) Patent No.: US 7,757,984 B2
(45) Date of Patent: Jul. 20, 2010

(54) FOOD PROCESSOR

(75) Inventors: Fang Chuan Lin, Taipei (TW); Chien Chung Lee, Taipei (TW); Sung Kai Chen, Taipei (TW); Shun Yung Chang, Taipei (TW); De Ming Wang, Taipei (TW); Kuan Wei Lee, Taipei (TW)

(73) Assignee: Star Comgistic Capital Co., Ltd., Taipei (TW)

( * ) Notice: Subject to any disclaimer, the term of this patent is extended or adjusted under 35 U.S.C. 154(b) by 778 days.

(21) Appl. No.: 11/690,129

(22) Filed: Mar. 22, 2007

(65) Prior Publication Data

US 2008/0230638 A1 Sep. 25, 2008

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |

(52) U.S. Cl. ..... 241/36; 99/486; 99/510; 366/314; 366/601

(58) Field of Classification Search ..... 241/36, 241/282.1, 282.2; 99/486, 510; 366/314, 366/601

See application file for complete search history.

(56) References Cited

U.S. PATENT DOCUMENTS

| | | | | |
|---|---|---|---|---|
| 4,541,573 | A | 9/1985 | Fujiwara et al. | |
| 5,347,205 | A | 9/1994 | Piland | |
| 5,727,742 | A | 3/1998 | Lawson | |
| 6,364,522 | B2 * | 4/2002 | Kolar et al. | 366/206 |
| 6,453,773 | B1 * | 9/2002 | Mochizuki et al. | 74/813 C |
| 6,609,821 | B2 | 8/2003 | Wulf et al. | |
| 2006/0086843 | A1 | 4/2006 | Lin et al. | |

FOREIGN PATENT DOCUMENTS

| | | |
|---|---|---|
| TW | 555539 | 10/2003 |

* cited by examiner

*Primary Examiner*—Bena Miller
(74) *Attorney, Agent, or Firm*—Squire, Sanders & Dempsey, L.L.P.

(57) ABSTRACT

A food processor includes a control unit that is operable in accordance with an initial control signal from a switch unit so as to activate a motor unit to operate in a sequence of an initial judgment mode and a food processing mode. The control unit switches operation of the motor unit from the initial judgment mode to the food processing mode upon determining a first target rotary speed in accordance with a motor rotation signal generated by a sensor unit for indicating a rotary speed of the motor unit during operation of the motor unit in the initial judgment mode so as to drive rotation of a cutting blade unit provided in a container to process food items contained in the container. The control unit activates the motor unit to rotate at a second target rotary speed associated with the first target rotary speed during operation of the motor unit in the food processing mode.

42 Claims, 5 Drawing Sheets

FOOD PROCESSOR

BACKGROUND OF THE INVENTION

1. Field of the Invention

The invention relates to a food processor, more particularly to a food processor that can process food items contained therein in accordance with a desired food processing state.

2. Description of the Related Art

A conventional blender is generally provided with various select buttons, each of which is operable to select a processing speed or operating mode of a motor unit for driving rotation of a cutting blade unit so as to blend food items to be processed. As such, in actual use, the user operates the select buttons based on previous experience in connection with the food items to be processed. Therefore, optimal processing of food items cannot be ensured for an inexperienced user.

SUMMARY OF THE INVENTION

The object of the present invention is to provide a food processor that can process food items contained therein in accordance with food processing conditions that were determined by the food processor based on a desired food processing state.

According to one aspect of the present invention, a food processor comprises:

a motor base including a housing and a motor unit mounted in the housing, the motor unit having a blade driving section disposed upwardly and outwardly of the housing;

a container adapted for containing food items and having a container bottom mounted removably on the housing, the container bottom being provided with a cutting blade unit that is coupled to the blade driving section when the container bottom is mounted on the housing and that is to be driven rotatably by the motor unit;

a switch unit mounted on the housing and operable so as to generate an initial control signal;

a sensor unit mounted in the housing and associated operably with the motor unit, the sensor unit generating a motor rotation signal for indicating a rotary speed of the motor unit; and a control unit mounted in the housing and connected to the motor unit, the switch unit and the sensor unit, the control unit being operable in accordance with the initial control signal from the switch unit so as to activate the motor unit to operate in a sequence of an initial judgment mode and a food processing mode.

The control unit determines a first target rotary speed ($S_1$) in accordance with the motor rotation signal generated by the sensor unit when the motor unit is operated in the initial judgment mode.

The control unit switches operation of the motor unit from the initial judgment mode to the food processing mode upon determining the first target rotary speed ($S_1$) so as to drive rotation of the cutting blade unit to process the food items contained in the container.

The control unit determines a second target rotary speed ($S_2$) in accordance with the first target rotary speed ($S_1$).

The control unit activates the motor unit to rotate at the second target rotary speed ($S_2$) upon determining the second target rotary speed ($S_2$) when the motor unit is operated in the food processing mode.

According to another aspect of the present invention, a food processor comprises:

a motor base including a housing and a motor unit mounted in the housing, the motor unit having a blade driving section disposed upwardly and outwardly of the housing;

a container adapted for containing food items and having a container bottom mounted removably on the housing, the container bottom being provided with a cutting blade unit that is coupled to the blade driving section when the container bottom is mounted on the housing and that is to be driven rotatably by the motor unit;

a switch unit mounted on the housing and operable so as to generate an initial control signal;

a sensor unit mounted in the housing and associated operably with the motor unit, the sensor unit generating a motor rotation signal for indicating a rotary speed of the motor unit; and a control unit mounted in the housing and connected to the motor unit, the switch unit and the sensor unit, the control unit being operable in accordance with the initial control signal from the switch unit so as to activate the motor unit to operate in a sequence of an initial judgment mode and a food processing mode.

The control unit determines a first target rotary speed ($S_1$) in accordance with the motor rotation signal generated by the sensor unit when the motor unit is operated in the initial judgment mode.

The control unit switches operation of the motor unit from the initial judgment mode to the food processing mode upon determining the first target rotary speed ($S_1$) so as to drive rotation of the cutting blade unit in accordance with the first target rotary speed ($S_1$) to process the food items contained in the container.

When the control unit detects an abnormal condition while the motor unit is activated by the control unit, the control unit switches operation of the motor unit to an abnormal processing mode.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
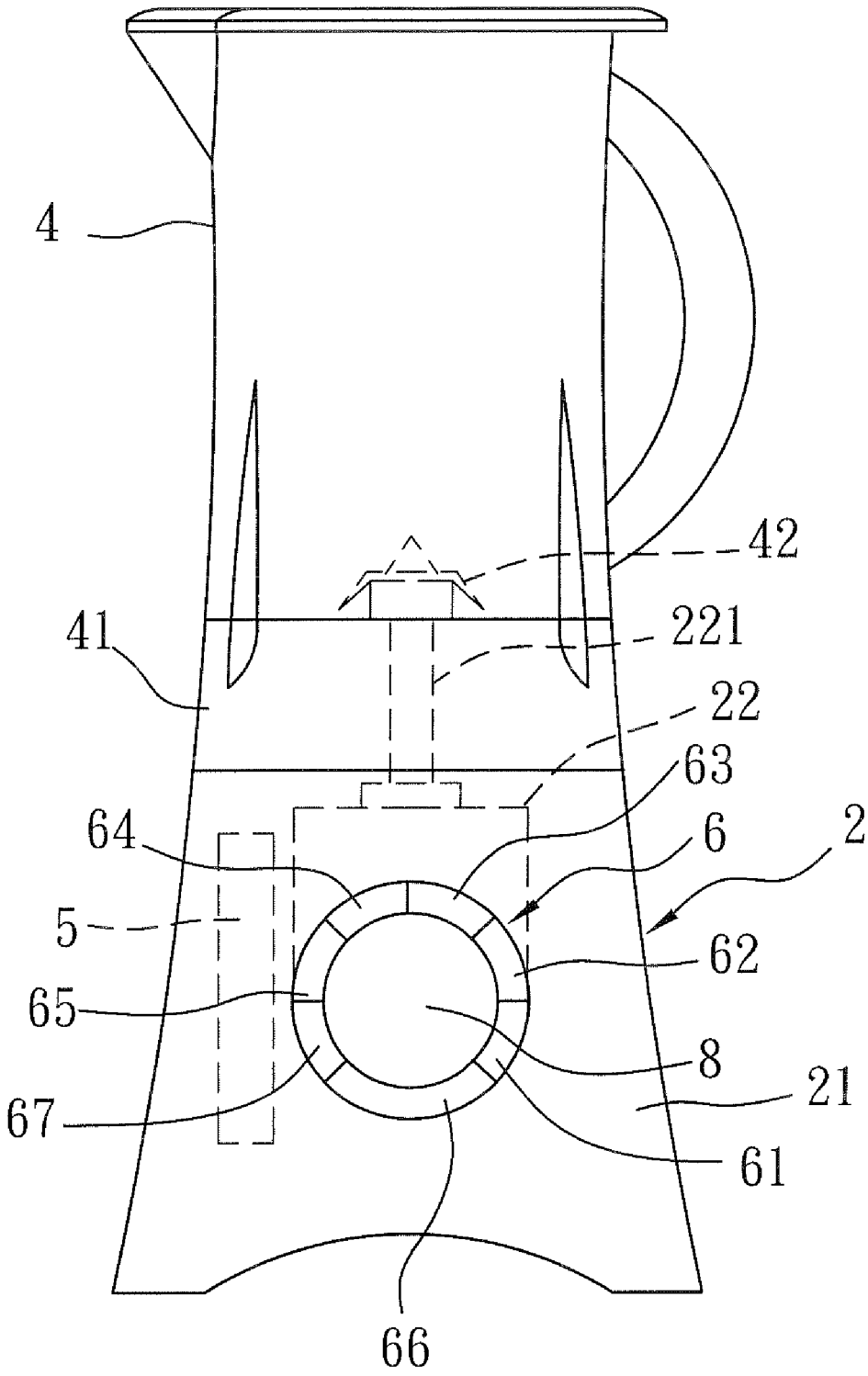
FIG. 1 is a schematic front view showing the preferred embodiment of a food processor according to this invention.
Figure 2:
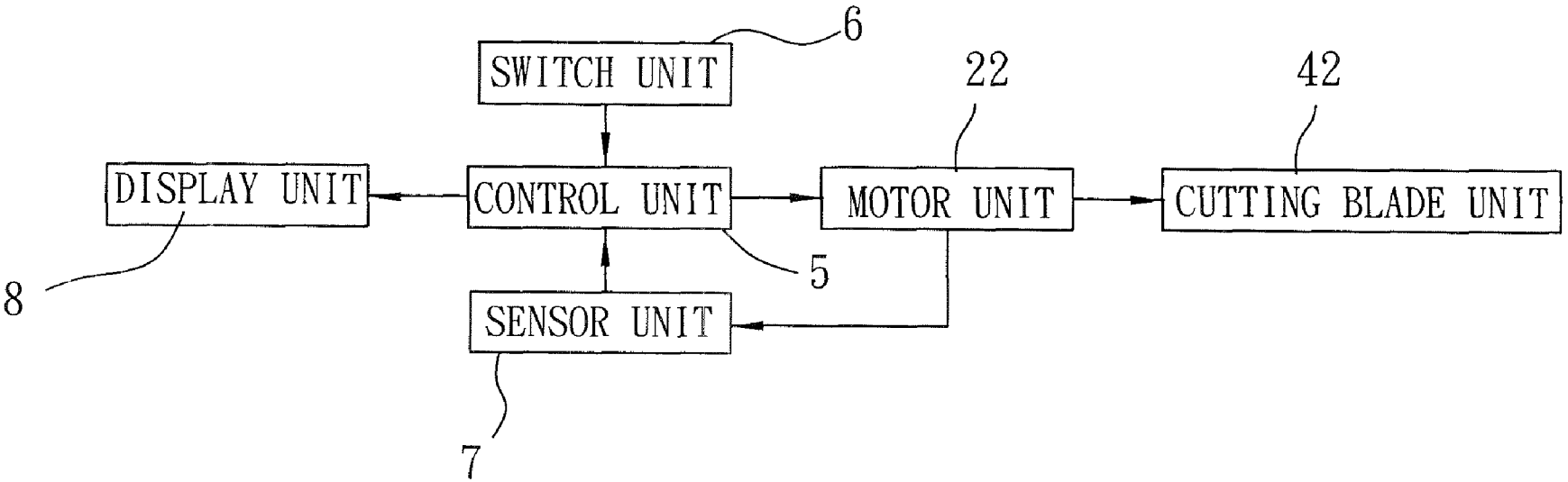
FIG. 2 is a schematic circuit block diagram of the preferred embodiment.

Referring to FIGS. 1 and 2, the preferred embodiment of a food processor according to the present invention is shown to be embodied in a blender, and includes a motor base 2, a container 4, a switch unit 6, a sensor unit 7, and a control unit 5.

The motor base 2 includes a housing 21, and a motor unit 22 mounted in the housing 21. The motor unit 22 has a blade driving section 221 disposed upwardly and outwardly of the housing 21.

The container 4 is adapted for containing food items (not shown), and has a container bottom 41 mounted removably on the housing 21 of the motor base 2. The container bottom 41 is provided with a cutting blade unit 42 that is coupled to the blade driving section 221 when the container bottom 41 is mounted on the housing 21 of the motor base 2 and that is to be driven rotatably by the motor unit 22, as shown in FIG. 1. In this embodiment, when the cutting blade unit 42 is driven by the motor unit 22 to rotate in a clockwise direction, sharpened edges of blades of the cutting blade unit 42 are leading edges such that food items (not shown) contained in the container 4 are cut.

The switch unit 6 is mounted on the housing 21, and is operable so as to generate an initial control signal. In this embodiment, the switch unit 6 includes first to fifth processing keys 61, 62, 63, 64, 65 mounted on the housing 21, a power key 66 for selectively enabling and disabling supply of electric power to the blender, and a pulse key 67 operable so as to forcibly enable the control unit 5 to activate the motor unit 22 to rotate in the clockwise direction at a predetermined largest speed. The initial control signal is associated with a depressed one of the first to fifth processing keys 61, 62, 63, 64, 65. In this embodiment, the first to fifth processing keys 61, 62, 63, 64, 65 respectively correspond to different food processing states, such as ice crush, smoothies, juice, soup, and dressing states.

The control unit 5 is mounted in the housing 21, and is connected to the motor unit 22, the switch unit 6 and the sensor unit 7.

The sensor unit 7 is mounted in the housing 21, and is associated operably with the motor unit 22. The sensor unit 7 generates a motor rotation signal for indicating a rotary speed of the motor unit 22 in a known manner.

A display unit 8 is mounted on the housing 21, and is connected to the control unit 5 for displaying processing-time information.

The control unit 5 is operable in accordance with the initial control signal from the switch unit 6 so as to activate the motor unit 22 to operate in a sequence of an initial judgment mode and a food processing mode.

Figure 3:
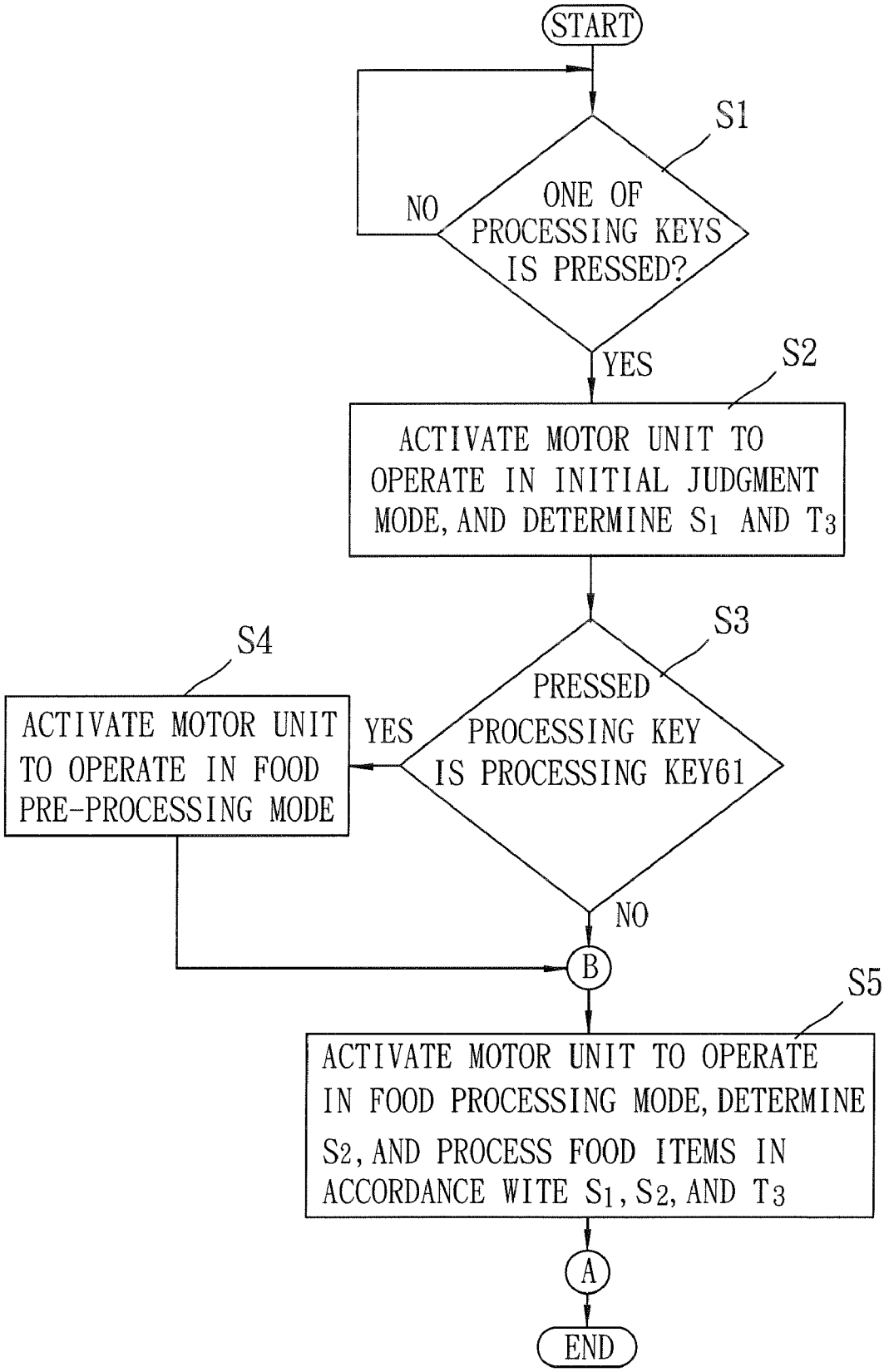
FIG. 3 is a flow chart illustrating operation of the preferred embodiment.

FIG. 3 illustrates the operating procedure of the blender of the preferred embodiment.

In step S1, the control unit 5 detects whether one of the processing keys 61, 62, 63, 64, 65 of the switch unit 5 is pressed. If negative, step S1 is repeated. When a pressed one of the processing keys 61, 62, 63, 64, 65 is detected, the control unit 5 receives the initial control signal, which is associated with the pressed one of the processing keys 61, 62, 63, 64, 65, from the switch unit 6, and the flow goes to step S2.

Figure 4:
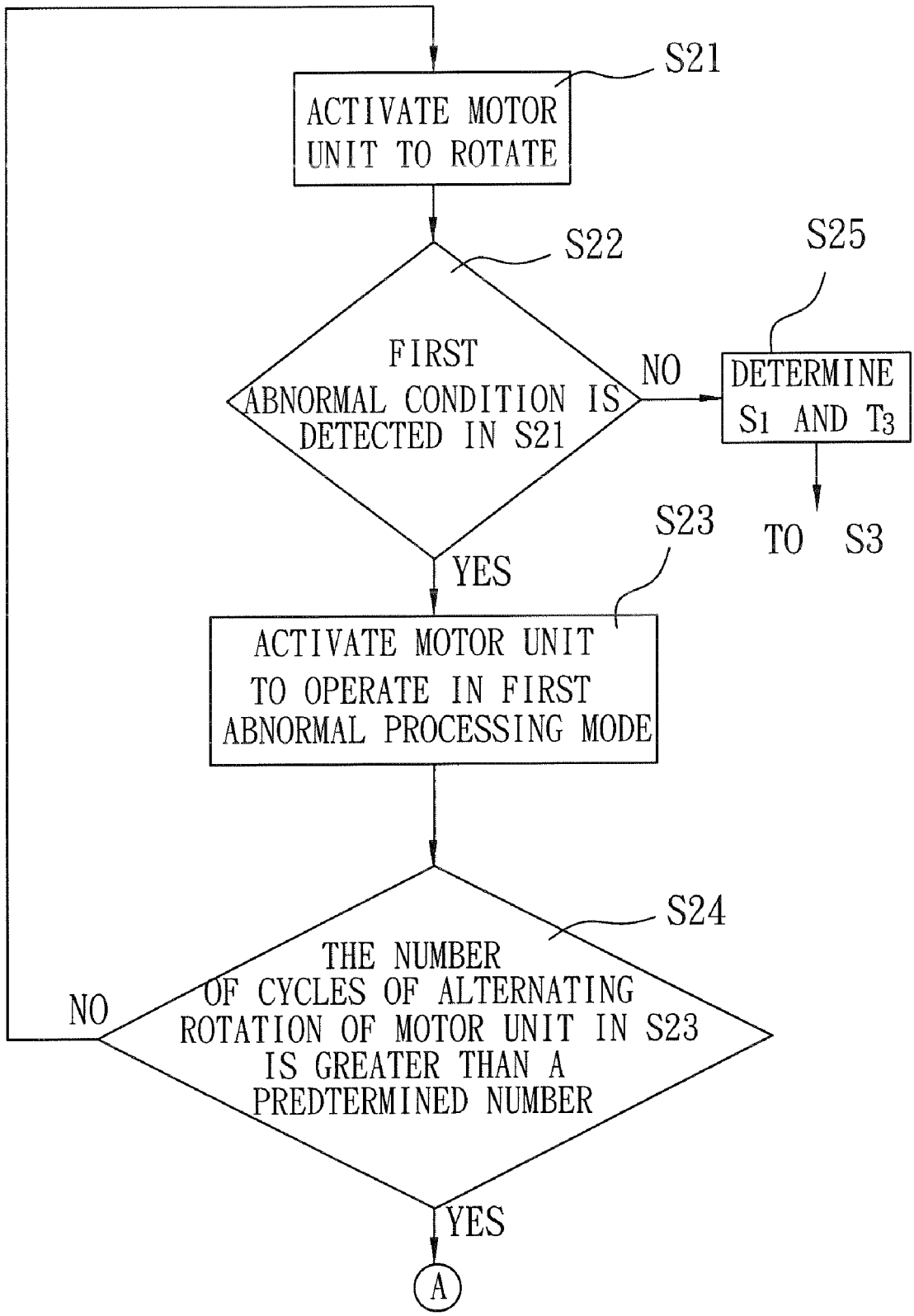
FIG. 4 is a flow chart illustrating operation of the preferred embodiment when a motor unit is operated in an initial judgment mode.

In step S2, the control unit 5 activates the motor unit 22 to operate in the initial judgment mode, and determines a first target rotary speed ($S_1$) and a total processing period ($T_3$) for operation of the motor unit 22 in the food processing mode in accordance with the motor rotation signal generated by the sensor unit 7. More specifically, FIG. 4 illustrates the operating procedure of the blender of the preferred embodiment when the motor unit 22 is operated in the initial judgment mode.

In step S21, the control unit 5 activates the motor unit 22 to rotate in the clockwise direction for a predetermined period, such as 1 second, by applying a fixed voltage to the motor unit 22.

In step S22, the control unit 5 determines whether a first abnormal condition is detected in step S21. In this embodiment, the first abnormal condition is that the rotary speed of the motor unit 22 is less than a predetermined rotary speed, such as 200 rpm, for a predetermined period, such as 0.5 second. If negative, the flow goes to step S25. When the control unit 5 detects the first abnormal condition, the flow goes to step S23.

In step S23, the control unit 5 activates the motor unit 22 to operate in a first abnormal processing mode. In this embodiment, during operation of the motor unit 22 in the first abnormal processing mode, the control unit 5 activates the motor unit 22 to rotate alternately in a first direction, such as a counterclockwise direction, for a predetermined first period, such as 1 second, and in a second direction, such as the clockwise direction, for a predetermined second period, such as 1 second, in cycles until the rotary speed of the motor unit 22 is no longer less than the predetermined rotary speed for the predetermined period. In this embodiment, in a first cycle of operation of the motor unit 22 in the first abnormal processing mode, the control unit 5 applies a predetermined standard voltage to the motor unit 22 to activate rotation thereof in the first direction for the predetermined first period, and subsequently applies a voltage equal to the predetermined standard voltage times a predetermined multiple, such as 1.5, to the motor unit 22 to activate rotation thereof in the second direction for the predetermined second period. On the other hand, in each of the other cycles of operation of the motor unit 22 in the abnormal processing mode, the control unit 5 applies the predetermined standard voltage to the motor unit 22 to activate rotation thereof in the first direction for the predetermined first period, and subsequently applies a voltage equal to the voltage applied to the motor unit 22 in a preceding cycle times the predetermined multiple to the motor unit 22 to activate rotation thereof in the second direction for the predetermined second period.

In step S24, the control unit 5 determines whether the number of cycles of alternating rotation of the motor unit 22 in step S23 is greater than a predetermined number, such as 4. If negative, the flow goes back to step S21. When the number of cycles of alternating rotation of the motor unit 22 in step S23 is greater than the predetermined number, the flow goes to the node (A), i.e., the control unit 5 deactivates the motor unit 22. In step S25, the control unit 5 determines a largest rotary speed ($S_H$) of the motor unit 22 in accordance with the motor rotation signal generated by the sensor unit 7 within the predetermined period. Therefore, the control unit 22 calculates the first target rotary speed ($S_1$) to be equal to a difference between a predetermined standard rotary speed ($S_s$) and the largest rotary speed ($S_H$), and a processing average rotary speed ($S_{avg}$) to be equal to a difference between a predetermined standard average rotary speed ($S_{sa}$) and the largest rotary speed ($S_H$). In other words, the first target rotary speed ($S_1$) and the processing average rotary speed ($S_{avg}$) can be respectively expressed using the following equations (1) and (2):

$$S1=S_s-S_H \quad (1)$$

$$S_{avg}=S_{sa}-S_H \quad (2).$$

The control unit 5 further determines a second time period ($T_1$) from a time at which the control unit 5 deactivates the motor unit 22 after the predetermined period of activation to a time at which the motor unit 22 does not rotate in accordance with the motor rotation signal generated by the sensor unit 7 after the predetermined period. The control unit 5 further determines the total processing period ($T_3$) for the food processing mode in accordance with the processing average rotary speed ($S_{avg}$), the largest rotary speed ($S_H$) and the second time period ($T_1$). Particularly, the total processing period ($T_3$) can be calculated according to the following equation (3):

$$T3=T_1/x+S_{avg}/y+(7-z)\times 4 \quad (3),$$

where x, y and z are preset first, second and third parameters, respectively. In this embodiment, the control unit 5 is configured with five sets of the preset first, second and third parameters (x, y, z) corresponding to the different food processing states (i.e., the ice crush, smoothies, juice, soup, and dressing states), as shown in Table 1. Upon determining the first target rotary speed ($S_1$) and the total processing period ($T_3$), the flow goes to step S3.

TABLE 1

| | x | y | z |
|---|---|---|---|
| ice crush state | 8 | 1 | 2 |
| smoothies state | 4 | 1 | 2 |
| juice state | 4 | 1 | 2 |
| soup state | 4 | 2 | 4 |
| dressing state | 4 | 4 | 5 |

In step S3, the control unit 5 determines whether the pressed processing key is the processing key 61, i.e., the desired food processing state is the ice crush state. If negative, the flow goes to step S5. Upon determining that the pressed processing key is the processing key 61, the flow goes to step S4.

In step S4, the control unit 5 activates the motor unit 22 to operate in a food pre-processing mode, where the control unit 5 activates the motor unit 22 to rotate intermittently for a predetermined number of cycles, and then the flow goes to step S5. In this embodiment, the predetermined number of cycles is 5 cycles. In each of the predetermined number of cycles of operation of the motor unit 22 in the food pre-processing mode, the control unit 5 activates the motor unit 22 to rotate for a predetermined period, such as 1 second, and then stop for a period until the motor unit 22 does not rotate.

Figure 5:
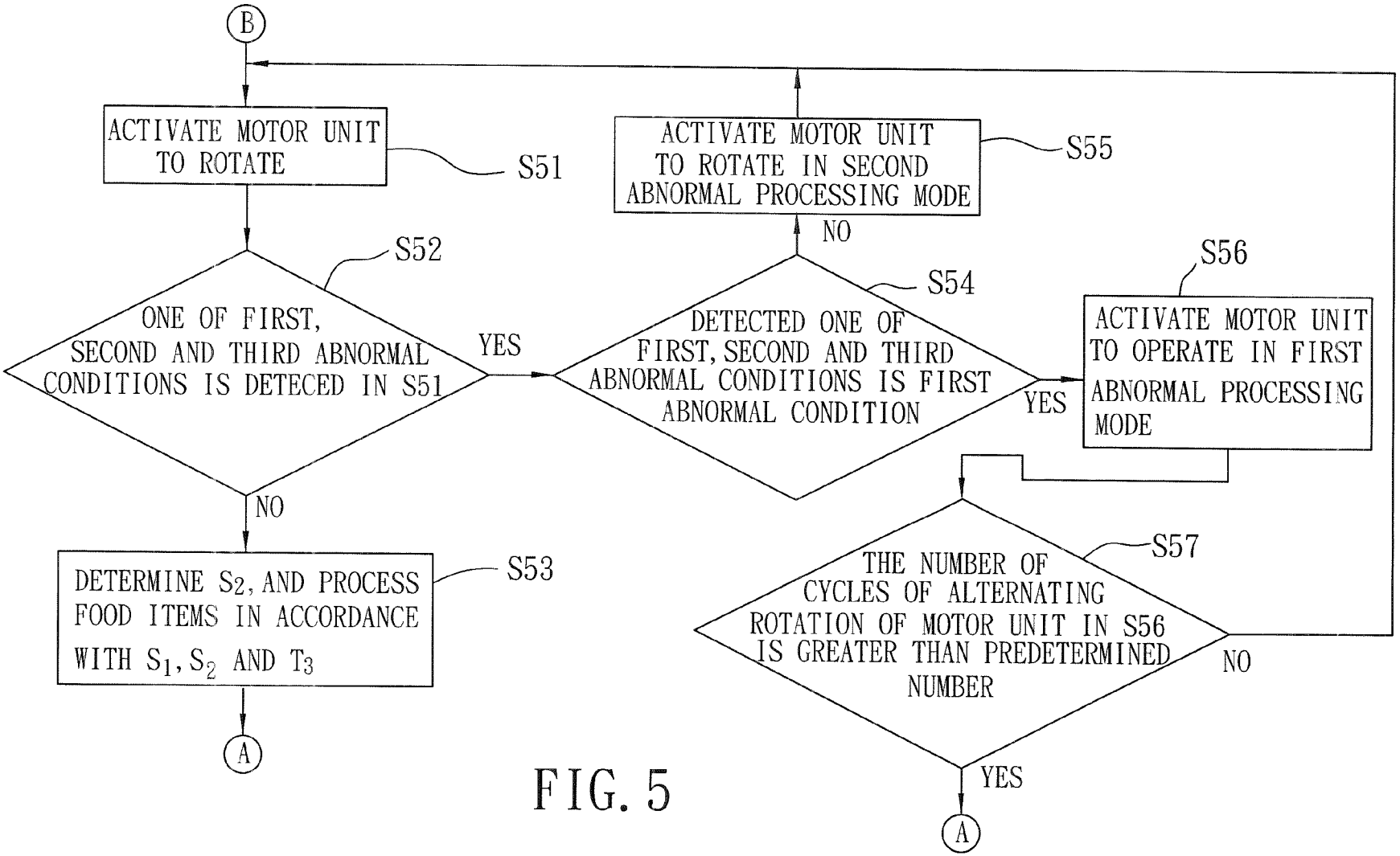
FIG. 5 is a flow chart illustrating operation of the preferred embodiment when the motor unit is operated in a food processing mode.

In step S5, the control unit 5 activates the motor unit 22 to operate in the food processing mode, and determines a second target rotary speed ($S_2$) so as to drive rotation of the cutting blade unit 42 to process the food items contained in the container 4 in accordance with the first target rotary speed ($S_1$), the second target rotary speed ($S_2$) and the total processing period ($T_3$). More specifically, FIG. 5 illustrates the operating procedure of the blender of the preferred embodiment when the motor unit 22 is operated in the food processing mode. When the operation of the motor unit 22 is switched to the food processing mode, the display unit 8 starts displaying the processing-time information that is a remaining processing time down-counting from the total processing period ($T_3$).

In step S51, the control unit 5 activates the motor unit 22 to rotate by applying a variable voltage thereto.

In step S52, the control unit 5 determines whether one of the first abnormal condition, and second and third abnormal conditions is detected in step S51. In this embodiment, the second abnormal condition is that a rotary speed increasing rate of the motor unit 22 is greater than a predetermined rotary speed increasing rate, such as 4000 rpm/second, and the third abnormal condition is that a rotary speed variation rate of the motor unit 22 is greater than a predetermined rotary speed variation rate, such as 8000 rpm/second, before the rotary speed of the motor unit 22 reaches the first target rotary speed ($S_1$). If negative, the flow goes to step S53. When the control unit 5 detects one of the first, second and third abnormal conditions, the flow goes to step S54.

In step S53, in one embodiment, the control unit 5 determines a second target rotary speed ($S_2$) in accordance with the first target rotary speed ($S_1$) and a first time period ($T_2$) from a time at which the control unit 5 initially activates the motor unit 22 in step S51 to a time at which the rotary speed of the motor unit 22 reaches the first target rotary speed ($S_1$) in step S51. Particularly, the second target rotary speed ($S_2$) can be calculated according to the following equation (4):

$$S_2=S_1+(T_2/20)\times C \quad (4),$$

where C is a predetermined constant of, for example, 200. Alternatively, in another embodiment, the control unit 5 determines a second target rotary speed ($S_2$) in accordance with the first target rotary speed ($S_1$) and a current ($I_1$) flowing through the motor unit 22 in step S51 when the rotary speed of the motor unit 22 reaches the first target speed ($S_1$) in step S51. Particularly, the second target rotary speed ($S_2$) can be calculated according to the following equation (5):

$$S_2=S_1+(I_1/20)\times D \quad (5),$$

where D is a predetermined constant of, for example, 200. Upon determining the second target rotary speed ($S_2$), the control unit 5 subsequently activates the motor unit 22 to rotate at the second target rotary speed ($S_2$) for a period of the remaining processing time displayed by the display unit 8, wherein the control unit 5 applies a variable voltage to the motor unit 22 to maintain the rotary speed thereof at the second target rotary speed ($S_2$). Therefore, the food items contained in the container 4 can be processed in accordance with food processing conditions including the first target rotary speed ($S_1$) and the total processing period ($T_3$) that were determined in step S2, and the second target rotary speed ($S_2$) determined in step S53.

In step S54, the control unit 5 determines whether the detected one of the first, second and third abnormal conditions is the first abnormal condition. If negative, the flow goes to step S55. Upon determining that the detected one of the first, second and third abnormal conditions is the first abnormal condition, the flow goes to step S56.

In step S55, the control unit 5 activates the motor unit 22 to operate in a second abnormal processing mode. If the detected one of the first, second and third abnormal conditions is the second abnormal condition, particularly, for the desired food processing state being one of the smoothies, juice, soup and dressing states, the food items contained in the container 4 are moved upwardly and centrifugally so that the cutting blade unit 42 cannot touch and cut the food items. As such, during operation of the motor unit 22 in the second abnormal processing mode, the control unit 5 activates the motor unit 22 to rotate intermittently for a predetermined number of cycles. In this embodiment, the predetermined number of cycles is 5 cycles. In each of the predetermined number of cycles of operation of the motor unit 22 in the second abnormal processing mode, the control unit 5 activates the motor unit 22 to rotate in the clockwise direction for a predetermined first period, such as 1 second, and then stop for a predetermined second period, such as 1 second.

On the other hand, if the detected one of the first, second and third abnormal conditions is the third abnormal condition, during operation of the motor unit 22 in the second abnormal processing mode, for the desired food processing state being one of the smoothies and juice states, the control unit 5 activates the motor unit 22 to rotate intermittently for a predetermined number of cycles. In this embodiment, the predetermined number of cycles is 5 cycles. In each of the predetermined number of cycles of operation of the motor unit 22 in the second abnormal processing mode, the control unit 5 activates the motor unit 22 to rotate for a predetermined first period, such as 3 seconds, and then stop for a predetermined second period, such as 1 second. However, for the desired food processing state being one of the soup and dressing states, the control unit 5 activates the motor unit 22 to rotate intermittently and alternately in the clockwise and counterclockwise directions for a predetermined number cycles. In this embodiment, the predetermined number of cycles is 5 cycles. In each of the predetermined number of cycles of operation of the motor unit 22 in the second abnormal processing mode, the control unit 5 activates the motor unit 22 to rotate in the clockwise direction for a predetermined first period, such as 3 seconds, stop for a period until the motor unit 22 does not rotate, and then rotate in the counterclockwise direction for a predetermined second period, such as 3 seconds.

After the operation of the motor unit 22 in the second abnormal processing mode is performed, the flow goes back to step S51. It is noted that, when the operation of the motor unit 22 is switched to the second abnormal processing mode, the processing-time information displayed by the display unit 8 does not down-count until the operation of the motor unit 22 in the second abnormal processing mode is finished.

In step S56, the control unit 5 activates the motor unit 22 to operate in the first abnormal processing mode as described in step S23 of FIG. 4. It is noted that, when the operation of the motor unit 22 is switched to the first abnormal processing mode, the processing-time information displayed by the display unit 8 stops down-counting.

In step S57, similar to step S24, the control unit 5 determines whether the number of cycles of alternating rotation of the motor unit 22 in step S56 is greater than the predetermined number. If negative, the flow goes back to step S51, and the processing-time information displayed by the display unit 8 resumes its down-count. When the number of cycles of alternating rotation of the motor unit 22 in step S56 is greater than the predetermined number, the flow goes to the node (A), i.e., the control unit 5 deactivates the motor unit 22.

Preferably, the display unit 8 further displays processing-state information and abnormal processing mode information.

In sum, the food processor of this invention can smoothly process the food items contained in the container 4 in accordance with the first and second target rotary speeds ($S_1$, $S_2$) and the total processing period ($T_3$) based on the desired food processing state by operation of the motor unit 22 in a sequence of the initial judgment mode and the food processing mode. Even if the aforesaid abnormal conditions are present during operation of the motor unit 22 in the initial judgment mode and the food processing mode, the abnormal conditions can be automatically eliminated by operation of the motor unit 22 in the aforesaid abnormal processing modes, thereby ensuring optimal processing of the food items, or otherwise, the motor unit 22 is deactivated, thereby avoiding damage to the motor unit 22 and ensuring safety during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A food processor comprising:

a motor base including a housing and a motor unit mounted in said housing, said motor unit having a blade driving section disposed upwardly and outwardly of said housing;

a container adapted for containing food items and having a container bottom mounted removably on said housing, said container bottom being provided with a cutting blade unit that is coupled to said blade driving section when said container bottom is mounted on said housing and that is to be driven rotatably by said motor unit;

a switch unit mounted on said housing and operable so as to generate an initial control signal;

a sensor unit mounted in said housing and associated operably with said motor unit, said sensor unit generating a motor rotation signal for indicating a rotary speed of said motor unit; and a control unit mounted in said housing and connected to said motor unit, said switch unit and said sensor unit, said control unit being operable in accordance with the initial control signal from said switch unit so as to activate said motor unit to operate in a sequence of an initial judgment mode and a food processing mode;

said control unit determining a first target rotary speed ($S_1$) in accordance with the motor rotation signal generated by said sensor unit when said motor unit is operated in the initial judgment mode;

said control unit switching operation of said motor unit from the initial judgment mode to the food processing mode upon determining the first target rotary speed ($S_1$) so as to drive rotation of said cutting blade unit to process the food items contained in said container;

said control unit determining a second target rotary speed ($S_2$) in accordance with the first target rotary speed ($S_1$);

said control unit activating said motor unit to rotate at the second target rotary speed ($S_2$) upon determining the second target rotary speed ($S_2$) when said motor unit is operated in the food processing mode.

2. The food processor as claimed in claim 1, wherein said control unit applies a variable voltage to said motor unit to maintain the rotary speed thereof at the second target rotary speed ($S_2$) when said motor unit is operated in the food processing mode.

3. The food processor as claimed in claim 1, wherein:

said control unit activates said motor unit to rotate for a predetermined period when said motor unit is operated in the initial judgment mode, and determines a largest rotary speed ($S_H$) of said motor unit in accordance with the motor rotation signal generated by said sensor unit within the predetermined period; and said control unit calculates the first target rotary speed ($S_1$) to be equal to a difference between a predetermined standard rotary speed and the largest rotary speed ($S_H$).

4. The food processor as claimed in claim 3, wherein:

said control unit further determines a second time period ($T_1$) from a time at which said control unit deactivates said motor unit after the predetermined period of activation to a time at which said motor unit does not rotate in accordance with the motor rotation signal generated by said sensor unit after the predetermined period when said motor unit is operated in the initial adjustment mode; and said control unit further determines a total processing period ($T_3$) for the food processing mode in accordance with a predetermined standard average rotary speed, the largest rotary speed ($S_H$) and the second time period ($T_1$).

5. The food processor as claimed in claim 4, wherein said control unit calculates the total processing period ($T_3$) as follows:

the total processing period ($T_3$)=the second time period ($T_1$)/a preset first parameter ($x$)+(7−a preset second parameter ($z$))×4+(the predetermined standard average rotary speed−the largest rotary speed ($S_H$))/a preset third parameter ($y$).

6. The food processor as claimed in claim 1, wherein the control unit determines the second target speed ($S_2$) in further accordance with a first time period ($T_2$) from a time at which said control unit initially activates said motor unit in the food processing mode to a time at which the rotary speed of said motor unit reaches the first target rotary speed ($S_1$) in the food processing mode.

7. The food processor as claimed in claim 6, wherein said control unit calculates the second target rotary speed ($S_2$) as follows:

the second target rotary speed ($S_2$)=the first target rotary speed ($S_1$)+(the first time period ($T_2$)/20)×a predetermined constant.

8. The food processor as claimed in claim 1, wherein the control unit determines the second target speed ($S_2$) in further accordance with a current ($I_1$) flowing through said motor unit in the food processing mode when the rotary speed of said motor unit reaches the first target speed ($S_1$) in the food processing mode.

9. The food processor as claimed in claim 8, wherein said control unit calculates the second target rotary speed ($S_2$) as follows:

the second target rotary speed ($S_2$)=the first target rotary speed ($S_1$)+(the current ($I_1$)/20)×a predetermined constant.

10. The food processor as claimed in claim 1, wherein said switch unit includes a power key for selectively enabling and disabling supply of electric power to said control unit, a pulse key operable so as to forcibly enable said control unit to activate said motor unit, and a first processing key, the initial control signal being associated with pressing of said first processing key and corresponding to a predetermined food processing state.

11. The food processor as claimed in claim 10, wherein said switch unit further includes second to fifth processing keys, the initial control signal being associated with a pressed one of said first to fifth processing keys.

12. A food processor comprising:

a motor base including a housing and a motor unit mounted in said housing, said motor unit having a blade driving section disposed upwardly and outwardly of said housing;

a container adapted for containing food items and having a container bottom mounted removably on said housing, said container bottom being provided with a cutting blade unit that is coupled to said blade driving section when said container bottom is mounted on said housing and that is to be driven rotatably by said motor unit;

a switch unit mounted on said housing and operable so as to generate an initial control signal;

a sensor unit mounted in said housing and associated operably with said motor unit, said sensor unit generating a motor rotation signal for indicating a rotary speed of said motor unit; and a control unit mounted in said housing and connected to said motor unit, said switch unit and said sensor unit, said control unit being operable in accordance with the initial control signal from said switch unit so as to activate said motor unit to operate in a sequence of an initial judgment mode and a food processing mode;

said control unit determining a first target rotary speed ($S_1$) in accordance with the motor rotation signal generated by said sensor unit when said motor unit is operated in the initial judgment mode;

said control unit switching operation of said motor unit from the initial judgment mode to the food processing mode upon determining the first target rotary speed ($S_1$) so as to drive rotation of said cutting blade unit in accordance with the first target rotary speed ($S_1$) to process the food items contained in said container;

when said control unit detects an abnormal condition while said motor unit is activated by said control unit, said control unit switching operation of said motor unit to an abnormal processing mode.

13. The food processor as claimed in claim 12, wherein:

said control unit activates said motor unit to rotate for a predetermined period when said motor unit is operated in the initial judgment mode, and determines a largest rotary speed ($S_H$) of said motor unit in accordance with the motor rotation signal generated by said sensor unit within the predetermined period; and said control unit calculates the first target rotary speed ($S_1$) to be equal to a difference between a predetermined standard rotary speed and the largest rotary speed ($S_H$).

14. The food processor as claimed in claim 13, wherein:

said control unit further determines a second time period ($T_1$) from a time at which said control unit deactivates said motor unit after the predetermined period of activation to a time at which said motor unit does not rotate in accordance with the motor rotation signal generated by said sensor unit after the predetermined period when said motor unit is operated in the initial adjustment mode; and said control unit further determines a total processing period ($T_3$) for the food processing mode in accordance with a predetermined standard average rotary speed, the largest rotary speed ($S_H$) and the second time period ($T_1$).

15. The food processor as claimed in claim 14, wherein said control unit calculates the total processing period ($T_3$) as follows:

the total processing period ($T_3$)=the second time period ($T_1$)/a preset first parameter ($x$)+(7−a preset second parameter ($z$)×4)+(the predetermined standard average rotary speed−the largest rotary speed ($S_H$))/a preset third parameter ($y$).

16. The food processor as claimed in claim 12, wherein:

said control unit determines a second target rotary speed ($S_2$) in accordance with the first target rotary speed ($S_1$); and said control unit activates said motor unit to rotate at the second target rotary speed ($S_2$) upon determining the second target rotary speed ($S_2$) when said motor unit is operated in the food processing mode.

17. The food processor as claimed in claim 16, wherein the control unit determines the second target speed ($S_2$) in further accordance with a first time period ($T_2$) from a time at which said control unit initially activates said motor unit in the food processing mode to a time at which the rotary speed of said motor unit reaches the first target rotary speed ($S_1$) in the food processing mode.

18. The food processor as claimed in claim 17, wherein said control unit calculates the second target rotary speed ($S_2$) as follows:

the second target rotary speed ($S_2$)=the first target rotary speed ($S_1$)+(the first time period ($T_2$)/20)×a predetermined constant.

19. The food processor as claimed in claim 16, wherein the control unit determines the second target speed ($S_2$) in further accordance with a current ($I_1$) flowing through said motor unit in the food processing mode when the rotary speed of said motor unit reaches the first target speed ($S_1$) in the food processing mode.

20. The food processor as claimed in claim 19, wherein said control unit calculates the second target rotary speed ($S_2$) as follows:

the second target rotary speed ($S_2$)=the first target rotary speed ($S_1$)+(the current ($I_1$)/20)×a predetermined constant.

21. The food processor as claimed in claim 16, wherein said control unit applies a variable voltage to said motor unit to maintain the rotary speed thereof at the second target rotary speed ($S_2$) when said motor unit is operated in the food processing mode.

22. The food processor as claimed in claim 12, wherein the abnormal condition is that the rotary speed of said motor unit is less than a predetermined rotary speed for a predetermined period while said motor unit is activated by said control unit during one of the initial judgment mode and the food processing mode.

23. The food processor as claimed in claim 22, wherein, when said motor unit is operated in the abnormal processing mode, said control unit activates said motor unit to rotate alternately in a first direction for a predetermined first period and in a second direction opposite to the first direction for a predetermined second period in cycles until the rotary speed of said motor unit is no longer less than the predetermined rotary speed for the predetermined period.

24. The food processor as claimed in claim 23, wherein the number of the cycles of alternating rotation of said motor unit in the abnormal processing mode is not greater a predetermined number.

25. The food processor as claimed in claim 24, wherein:

in a first cycle of operation of said motor unit in the abnormal processing mode, said control unit applies a predetermined standard voltage to said motor unit to activate rotation thereof in the first direction for the predetermined first period, and subsequently applies a voltage equal to the predetermined standard voltage times a predetermined multiple to said motor unit to activate rotation thereof in the second direction for the predetermined second period; and in each of the other cycles of operation of said motor unit in the abnormal processing mode, said control unit applies the predetermined standard voltage to said motor unit to activate rotation thereof in the first direction for the predetermined first period, and subsequently applies a voltage equal to the voltage applied to said motor unit in a preceding cycle times the predetermined multiple to said motor unit to activate rotation thereof in the second direction for the predetermined second period.

26. The food processor as claimed in claim 25, wherein:

each of the predetermined first and second periods is a time period of 1 second; and the predetermined multiple is 1.5.

27. The food processor as claimed in claim 12, wherein the abnormal condition is that a rotary speed increasing rate of said motor unit is greater than a predetermined rotary speed increasing rate during operation of said motor unit in the food processing mode.

28. The food processor as claimed in claim 27, wherein, during operation of said motor unit in the abnormal processing mode, said control unit activates said motor unit to rotate intermittently for a predetermined number of cycles.

29. The food processor as claimed in claim 28, wherein, in each of the predetermined number of cycles of operation of said motor unit in the abnormal processing mode, said control unit activates said motor unit to rotate for a predetermined first period and then stop for a predetermined second period.

30. The food processor as claimed in claim 29, wherein:

the predetermined number of cycles is 5 cycles; and each of the predetermined first and second periods is a time period of 1 second.

31. The food processor as claimed in claim 12, wherein the abnormal condition is that a rotary speed variation rate of said motor unit is greater a predetermined rotary speed variation rate during operation of said motor unit in the food processing mode before the rotary speed of said motor unit reaches the first target rotary speed ($S_1$).

32. The food processor as claimed in claim 31, wherein, during operation of said motor unit in the abnormal processing mode, said control unit activates said motor unit to rotate intermittently for a predetermined number of cycles.

33. The food processor as claimed in claim 32, wherein, in each of the predetermined number of cycles of operation of said motor unit in the abnormal processing mode, said control unit activates said motor unit to rotate for a predetermined first period and then stop for a predetermined second period.

34. The food processor as claimed in claim 33, wherein:

the predetermined number of cycles is 5 cycles; and the predetermined first period is a time period of 3 seconds, and the predetermined second period is a time period of 1 second.

35. The food processor as claimed in claim 31, wherein, during operation of said motor unit in the abnormal processing mode, said control unit activates said motor unit to rotate intermittently and alternately in opposite first and second directions for a predetermined number of cycles.

36. The food processor as claimed in claim 35, wherein, in each of the predetermined number of cycles of operation of said motor unit in the abnormal processing mode, said control unit activates said motor unit to rotate in the first direction for a predetermined first period, stop for a period until said motor unit does not rotate, and then rotate in the second direction for a predetermined second period.

37. The food processor as claimed in claim 36, wherein:

the predetermined number of cycles is 5 cycles; and each of the predetermined first and second periods is a time period of 3 seconds.

38. The food processor as claimed in claim 12, wherein said control unit further activates said motor unit to operate in a food pre-processing mode, where said control unit activates said motor unit to rotate intermittently for a predetermined number of cycles, between the initial judgment mode and the food processing mode.

39. The food processor as claimed in claim 38, wherein, in each of the predetermined number of cycles of operation of said motor unit in the food pre-processing mode, said control unit activates said motor unit to rotate for a predetermined period and then stop for a period until said motor unit does not rotate.

40. The food processor as claimed in claim 39, wherein:

the predetermined number of cycles is 5 cycles; and the predetermined period is a time period of 1 second.

41. The food processor as claimed in claim 12, wherein said switch unit includes a power key for selectively enabling and disabling supply of electric power to said control unit, a pulse key operable so as to forcibly enable said control unit to activate said motor unit, and a first processing key, the initial control signal being associated with pressing of said first processing key and corresponding to a predetermined food processing state.

42. The food processor as claimed in claim 41, wherein said switch unit further includes second to fifth processing keys, the initial control signal being associated with a pressed one of said first to fifth processing keys.

* * * * *